United States Patent [19]

Koepke et al.

[11] Patent Number: 4,572,849

[45] Date of Patent: Feb. 25, 1986

[54] PROCESS FOR THE MULTIPLE COATING OF MOVING WEBS

[75] Inventors: Günther Koepke, Odenthal; Hans Frenken, Odenthal-Osenau; Heinrich Bussmann; Kurt Browatzki, both of Leverkusen, all of Fed. Rep. of Germany

[73] Assignee: Agfa-Gevaert Aktiengesellschaft, Leverkusen, Fed. Rep. of Germany

[21] Appl. No.: 540,374

[22] Filed: Oct. 11, 1983

[30] Foreign Application Priority Data

Oct. 21, 1982 [DE] Fed. Rep. of Germany ..... 3238904

[51] Int. Cl.[4] ..... B05D 1/36; B05D 7/00; G03C 1/74

[52] U.S. Cl. ..... 427/402; 427/414; 427/420; 430/935

[58] Field of Search ..... 430/935; 118/407, 412, 118/411, 401, 403; 427/402, 414, 420

[56] References Cited

U.S. PATENT DOCUMENTS

| | | | |
|---|---|---|---|
| 3,893,410 | 7/1975 | Herzhoff et al. | 118/412 |
| 4,113,903 | 9/1978 | Choinski | 427/420 |
| 4,299,188 | 11/1981 | Isayama et al. | 118/412 |
| 4,384,015 | 5/1983 | Koepke et al. | 427/402 |

*Primary Examiner*—Michael R. Lusignan

*Attorney, Agent, or Firm*—Connolly and Hutz

[57] ABSTRACT

A process for the multiple coating of webs which are continuously moving past a coating point, using coating apparatus according to the bead coating process is carried out such that any number of comparatively high viscosity layers is arranged above an accelerating layer which lies below the layers and has a viscosity range of from 1 to 20 mPas and a layer thickness of from 2 to 30 μm. A very small gap width of from 100 to 400 μm is selected between the sliding surface coating head and the web to be coated and only a low reduced pressure is applied under the coating head. By this process, coating rates of 400 m/min and more may be achieved with a good coating quality.

5 Claims, 1 Drawing Figure

PROCESS FOR THE MULTIPLE COATING OF MOVING WEBS

Figure 1:
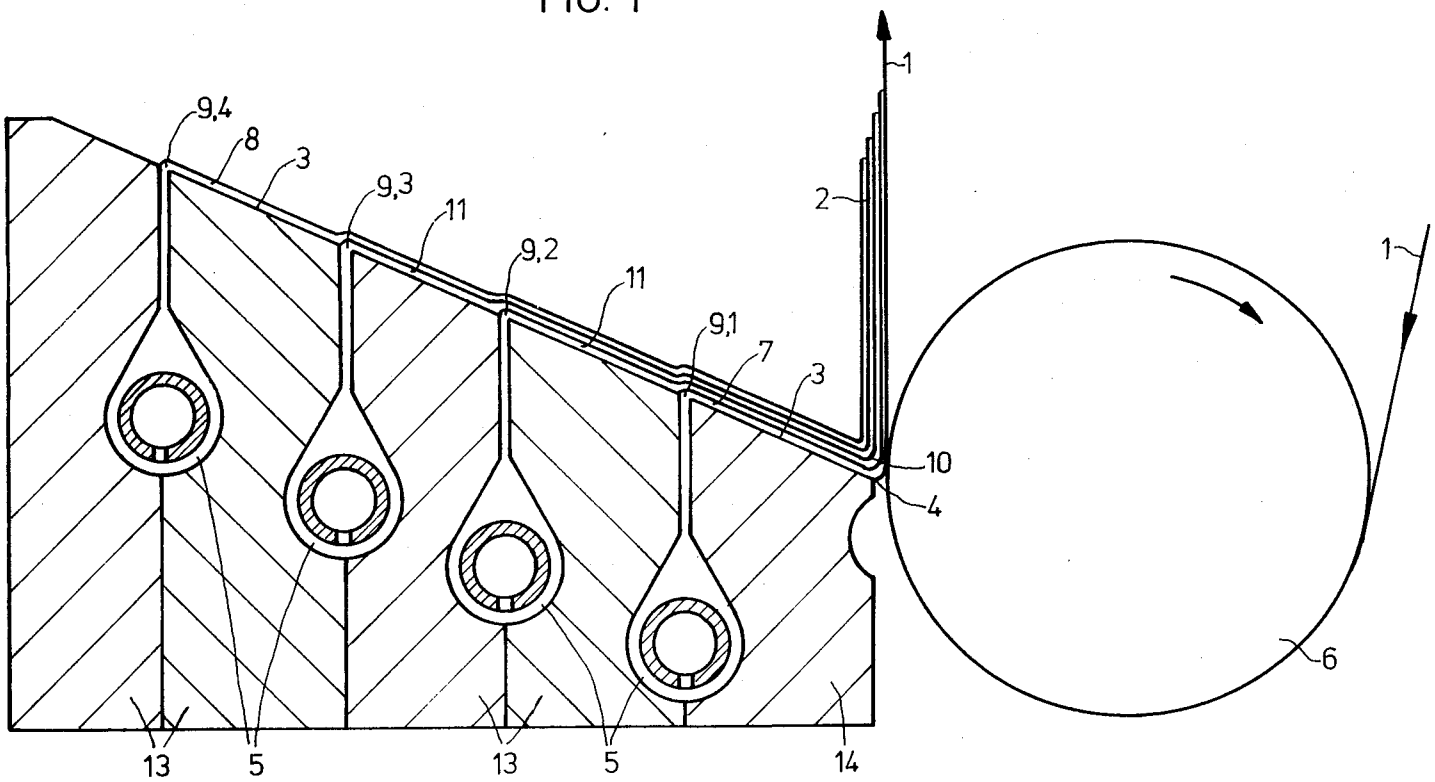

This invention relates to a process for the multiple coating of webs which are continuously moving past a coating point, by means of coating apparatus according to the bead coating process using a sliding surface coating head.

One multilayer process which is of importance for the photographic industry is the cascade coating process, in which one or more layers simultaneously flow down an inclined surface and are delivered onto a web which is moving continuously past, across a small spacing between the coating edge and the web by way of a bead. In the literature, this type of process is also termed a "bead coating process".

Experiments have shown that according to present day demands, it is only possible using the cascade or bead coating process to achieve casting rates which, in many cases, are not high enough from an economic point of view. As shown by general experience, a reduction in the casting rate is to be reckoned with, particularly in the case of comparatively high viscosities of the coating compositions and when there is a comparatively high solids concentration in the coating compositions. On the other hand, however, high solids concentrations and high viscosities which are associated therewith, are advantageous in that the quantity of water to be removed by drying is reduced and drying energy is saved, so that the installation may function in a more financially favourable manner. Last but not least, comparatively high viscosities also produce better casting qualities, because they prevent a reduction in the good casting quality achieved at the casting point during hardening and drying.

Thus, attempts have been made to overcome these disadvantages and to achieve a high casting rate in the case of high viscosities. U.S. Pat. No. 4,001,024 describes a process in which the lowest layer having a low viscosity and a low moisture application is applied under a layer which has a higher viscosity and a greater layer thickness. Any layer package may then be built up on these two lower layers. It is a requirement that the two lower layers be composed of the same materials or of such materials which do not exhibit any photographic effects when they are mixed together. On the other hand, the mixing of these layers is required during casting. According to the description, the viscosity of the first layer should range from 1 to 10 mPas and the viscosity of the second layer should range from 10 to 100 mPas, and the layer thickness of the first layer should range from 2 to 12 micrometers, and that of the second layer should range from 15 to 30 micrometers. In this process, a mixing of the two layers caused by a whirl formation in the meniscus is a disadvantage, giving rise to possibilities of defects in the photographic layer. Another restriction imposed by the process arises from the requirement that the first and second layers are either to be made of the same material or of materials which do not produce any photographic effects. When this process is applied, rates of only up to 3.55 m/s or 210 m/min are achieved.

The U.S. Pat. No. 4,113,903 refers to the disadvantages of the process according to the above-mentioned U.S. Pat. No. 4,001,024, referring in particular to the fact that in the case of a very low viscosity, the layers readily become unstable. This instability may be prevented to a certain extent by the application of a vacuum under the bead between the caster and the web, but these instabilities restrict the speed of the web. Therefore, this publication proposes the selection of a material for the lower layer which is normally of a high viscosity and which becomes thinly liquid and of a low viscosity under a shearing strain and thus has the required low viscosity only in the critical coating region, namely in the region of the bead or meniscus. However, this process requires a particular selection of material for the lowest layer which is not always compatible with the photographic purpose of the complete layer structure.

British Pat. No. 2,070,459 describes another process which estabilishes the mutual ratio of the viscosities of the first and second layers within narrow limits, and the viscosities of the layers should have the ratio $\eta_1=(0.9-1.1)\eta_2$. The viscosities of the two layers should, moreover, change in a different manner under the effect of shearing forces, such that the viscosity of the first layer is reduced by more than that of the second layer. There is no longer a free choice of the layer composition in this process either.

An object of the present invention is to provide a process of the initially mentioned type, with which it is easily possible to achieve a high coating rate without the layers mixing together or the choice of the substances for the layer structure being restricted, and the photographically active layer package comprises layers which have a high solids proportion and a high viscosity, and thus, a particularly low moisture application making possible a curtailment of the drying time.

Proceeding from a process of the initially-mentioned type, the object is achieved according to the present invention in that any number of comparatively high viscosity layers is positioned above an accelerating layer which lies below the layers and has a viscosity range of from 1 to 20 mPas and a layer thickness of from 2 to 30 μm, that the bulge formation is carried out over a gap spacing between a sliding surface coating head and the web to be coated of from 100 to 400 μm, preferably from 100 to 200 μm, and a reduced pressure of from 0 to 8 mbar, preferably from 0 to 3 mbar is applied under the coating bead.

In a preferred embodiment of the present process, an accelerating layer is selected which has a viscosity of from 2 to 10 mPas preferably from 2 to 3 mPas and has a layer thickness of from 2.5 to 10 μm, in particular, from 2.5 to 5 μm.

One process which is particularly advantageous with respect to very high coating rates is distinguished in that another low viscosity layer as a spreading layer having a viscosity range of from 1 to 10 mPas and a layer thickness of from 5 to 20 μm is positioned above the low viscosity accelerating layer and above any number of comparatively high viscosity layers.

The lower, low viscosity, so-called accelerating layer flows between the photographically active layer package and the coating apparatus and forms the join between the layer package and the webs which are to be coated and move continuously past the coating point.

Surprisingly, in the case of high web speeds, the narrow gap spacing smooths the bead into a curve in which whirls do not arise. The web is wetted regularly but the lowest, accelerating layer is prevented from mixing with the superimposed layer(s). The reduced pressure below the gap between the web and the sliding surface casting head is kept very low, and in some cases, may be adjusted to 0 to 1 mbar.

The so-called spreading layer which is also of a low viscosity, is applied to the layer package as the uppermost layer and it covers the package during the formation thereof, during and after coating.

This type of method allows the use in the layer package of high viscosity solutions having a high solids content and thus a low layer thickness at high casting rates, and thus makes it possible to save energy in the drying installation.

Surprisingly, it has been found that the combination of an accelerating layer and a spreading layer allows an outstanding casting quality with layer packages which could not otherwise be cast or could only be cast at low coating rates. It is also surprising that when the process is used in the cascade coating process, the layers do not intermix and, thus, there is also no danger of impairment of the casting quality. Furthermore, it is surprising that this accelerating layer may be adjusted so that it is thin with respect to layer thickness and viscosity, such that disadvantageous consequences do not occur in the further operations, such as, during hardening of the layers. Another surprising advantage is that by the use of a thin, low viscosity spreading layer, high viscosity layer packages which tend to contract, may be spread without fault. However, it is particularly surprising that when a combination of an accelerating layer and a spreading layer is used with the cascade or bead coating process, casting rates of 400 m/min (6–7 m/s) and more may be achieved.

This behaviour may perhaps be explained as follows.

In the case of high coating rates, the layer package which runs down the cascade is very greatly accelerated and consequently stretched over the short distance of the bead or the meniscus, i.e., the distance between the caster and the web. Very strong forces act on the layer package and, in the case of comparatively high speeds, they lead to a partial tearing of the layer package or to instabilities in the package. The effects of the accelerating layer are twofold. Firstly, the speed of the layer package on the run-off surface of the cascade is greatly increased by the accelerating layer. Secondly, the forces which arise during impact with the moving webs, are absorbed by the accelerating layer, or they only become effective in a delayed manner. The good casting quality may also be explained by these effects, because the layer package which determines the quality of the photographic material is not adversely affected as regards quality by any influences in the meniscus or during contact with the web.

These conditions may be appraised by a calculation. This may be carried out using, for example, two layers, one of which has a viscosity of 500 mPas and the other of which has a viscosity of 2 mPas. The thicker layer is to be applied to be web in a layer thickness of 100 μm at a web speed of 330 m/min. The thinner layer may be applied as the second layer, in a thickness of 2 μm. Consequently, the thicker layer runs down the cascade at a rate of 7.9 m/min in a layer thickness of 5730 μm. If the layer package is applied in the reverse order, i.e., the layer having a viscosity of 2 mPas is applied as the lower layer and the layer having a viscosity of 500 mPas is applied as the upper layer, then it is found that the upper layer of 500 mPas is accelerated by approximately a factor of 2 and attains a speed of 16.84 m/min. This also explains the term "accelerating layer".

Furthermore, the layer thickness of the high viscosity layer is reduced to 1809 μm, i.e., by approximately a factor of 3. This means that for this layer to produce the correct web application, it only has to be stretched by a factor of 18, whereas in the first case, stretching by a factor of 57 was necessary. This high stretching then results in a break-up of the layer.

In the bead coating process, layer-specific and geometric conditions of the coating apparatus have to be combined. A correct choice of the spacing between the caster edge and the web, and the choice of the reduced pressure below the bead are particularly important factors in this process. A small spacing between the coating apparatus and the web is necessary for the bead coating according to the present process. This small spacing is a prerequisite for achieving the good casting quality just as is the low reduced pressure which is therewith possible and necessary and may be reduced to zero or almost zero during the coating according to the present process. Furthermore, in order to allow the accelerating layer to be effective, it is not permissible to keep within a specific length of the last run-off surface. However, due to the selection of the small spacing between the web and the casting device, it is possible to freely select the type of layer composition for the accelerating layer, i.e., any polymer solutions may be used, for example gelatin, cellulose derivatives, polysaccharides or, in certain cases, wetting agent solutions. The layer thickness of these solutions may be advantageously selected so that the layer package—thus, in the case of photographic materials, the photographically active emulsion layers—is/are not adversely influenced.

The effect of the spreading layer which allows a further increase in the coating rate, particularly in the case of high viscosities, may be explained as follows. High viscosity casting solutions have the property of contracting under the influence of surface tension. This tendency may be reduced by the thin spreading layer which covers the surface of the high viscosity layers.

The process for the production of multilayered coatings will now be described in more detail in the following with reference to a drawing, using the example of coating photographic materials.

FIG. 1 illustrates a section through a cascade caster for carrying out the bead coating process.

The cascade caster according to FIG. 1 comprises in a known construction, several blocks 13, 14 which are positioned parallel to one another, are screwed together and are laterally restricted by front plates, and include distributor chambers 5 through which the coating liquids 7, 8, 11 enter into the caster via supply channels and metering devices (not shown) and ascend in gaps to the outlets slits 9.1 to 9.4 to be distributed over the caster width.

The coating materials 8, 11 flow down inclined surfaces 3 from the outlet slits and, one stage lower, lie over the coating materials which are already flowing down. An accelerating layer 7 which is characteristic of this process issues from the outlet slit 9.1 which lies nearest the coating bead or meniscus 10. Over the last part of the inclined surface 3, the layer package from the outlet slits 9.2 to 9.4 lies on this accelerating layer 7. A spreading layer 8 is supplied from the uppermost outlet slit 9.4 over the intended layer structure from the slits 9.2 and 9.3. This spreading layer 8 guarantees a perfectly spread form to the layer package by preventing the formation of a boundary surface between the package and the air. The complete structure of the accelerating layer 7, the layer package 11 and the spreading layer 8 bridges the meniscus (applied bead) of the caster edge 4 and is guided so that only a minimum absorption depth for the bead 10 is produced. Consequently, the photographically active layer package 11 is positioned in a curve on the substrate to be coated, and the accelerating layer 7 between the coating edge 4 and the web 1 forms only a very small bead 10 which is quite adequate for producing a very good wetting of the web 1 on the casting roller 6, even in the case of high coating rates. During wetting of the web 1, the accelerating layer 7 causes a considerable reduction in the accelerating forces which act on the layer package 11 to be applied, so that the package 11 may be coated on the web 1 without an impairment to the quality by the accelerating forces. The spreading layer 8 shields the upper side of the layer package 1 on the boundary surfaces, from ambient air and prevents the high viscosity layers 11 from contracting and, thus, smooths the surface of the web coating 2.

The considerable and surprising advantage of the process according to the present invention lies, as far as cascade casting is concerned, in the unexpected increase in the casting rates for high viscosity coating materials 11, which may be further increased by the additional spreading layer. Consequently, a high quality casting is achieved.

Furthermore, it has surprisingly been found that surface-active substances are no longer necessary in the photographically active coating materials 11, thus allowing financial savings to be made.

Even the accelerating layer 7 and the spreading layer 8 only require small quantities of surface-active substances. In certain cases, even these layers may be used without surface-active substances.

By this process, webs may be coated with a plurality of, for example, 12 or more layers with the most varied coating materials.

In principle, the process of the present invention may be used for coating cohesive webs of paper, plastics materials, glass, wood and textiles. As already mentioned, the process is particularly suitable for casting photographic substrates with photographic emulsions.

All conventional web-shaped materials may be used for the production of photographic materials, for example, film webs of cellulose nitrate, cellulose triacetate, polyvinyl acetate, polycarbonate, polyethyleneterephthalate, polystyrene and the like, and the most varied paper webs may be used with or without plastic materials coatings on their surfaces.

According to the present process, photographic layers may be applied which contain silver halides as photosensitive compounds, and those photographic layers may also be applied which contain photosensitive dyes or photoconductive zinc oxides and titanium dioxide. The layers may also contain other additives than those which are known in the photographic layers production field, for example carbon blacks, matting agents, such as, silicon dioxide or polymeric development auxiliaries and the like.

The photographic layers may also contain various hydrophilic colloids as binders. Examples of such colloids include, in addition to proteins, such as gelatin, cellulose derivatives, polysaccharides, such as starch, sugar, dextran or agar-agar. Synthetic polymers, such as, polyvinyl alcohol or polyacrylamide or mixtures of such binders may also be used. Moreover, the coating process of the present invention may, of course, also be used for the production of non-photographic layers, for example for the production of magnetone layers or other colour and lacquer layers.

A few possibilities of coatings will now be illustrated using Examples. The Examples are only a selection and, thus, can only provide a survey which makes no claim to completeness. The Tables illustrated in the following Examples use symbols which are defined as follows:

$\eta$ = Viscosity [mPas]
$\sigma$ = Surface tension [m N/m]
$\delta$ = Wet application to the web [$\mu$m]
$\nu$ = Web speed [m/min]

EXAMPLE 1

A coating apparatus according to FIG. 1 was used for the bead application process. The layers to be applied had the following composition:

| | Layer 1 | Layer 2 |
|---|---|---|
| $\eta$ | 300 | 15 |
| $\delta$ | 20 | 20 |
| $\partial$ | 19 | 24 |

The coating rate limit was already reached at 50 m/min, whereby a reduced pressure of 7 mbar was used. The casting quality was poor. A paper web having a PE coating was used as the material to be coated.

EXAMPLE 2

A coating apparatus according to FIG. 1 was used for the bead application process. The layers to be applied had the following composition:

| | Layer 1 | Layer 2 |
|---|---|---|
| $\eta$ | 15 | 670 |
| $\delta$ | 10 | 20 |
| $\partial$ | 20 | 19 |

A casting rate of 100 m/min could be achieved, whereby a reduced pressure of 6 mbar was applied. The spacing between the casting apparatus and the web was 175 $\mu$m. The quality of the coating on the paper substrate having a PE coating was good.

EXAMPLE 3

A caster according to FIG. 1 was used for the bead application process. The layers which were applied had the following composition:

| | Accelerating Layer | Photographic Layer |
|---|---|---|
| $\eta$ | 15 | 2100 |
| $\delta$ | 6 | 25. |

The casting rate was 130 m/min with a reduced pressure of 7 mbar. The caster spacing could be varied between 100 and 200 $\mu$m with a good casting quality.

EXAMPLE 4

A caster according to FIG. 1 was used for the bead application process. The layers which were applied had the following composition:

| | Accelerating Layer | Photographic Layer |
|---|---|---|
| $\eta$ | 2 | 50 |
| $\delta$ | 2.5 | 100 |

The casting rate was 200 m/min with a reduced pressure of 4 mbar and a caster spacing of 175 μm. The casting quality of the layer package was good.

EXAMPLE 5

A caster for 6 layers was used for the bead application process. The layers to be applied had the following composition:

| | Accelerating layer | Photographic layers | | | | |
|---|---|---|---|---|---|---|
| | | 1 | 2 | 3 | 4 | 5 |
| $\eta$ | 10 | 630 | 655 | 630 | 665 | 630 |
| $\delta$ | 15 | 8 | 8 | 8 | 8 | 8 |

The casting rate was 100 m/min with a reduced pressure of 4 mbar and a caster spacing of 175 μm. The casting quality of the layer package was good.

EXAMPLE 6

A casting apparatus according to FIG. 1 was used as the caster for the bead application process for a three layered casting. The coating data for the individual layers are as follows:

| | Accelerating layer | Photographic layer | Spreading layer |
|---|---|---|---|
| $\eta$ | 2 | 50 | 5 |
| $\delta$ | 2.5 | 100 | 20 |
| $\partial$ | 31.5 | 29.7 | 28 |

Casting rates of $\nu=400$ m/min and more could be achieved. The reduced pressure which was applied between the caster edge 4 and the web 1 was only 1 mbar with a spacing between the caster edge 4 and the web 1 of 175 μm. Cellulose triacetate was used as the web material. The casting quality was good.

EXAMPLE 7

A paper coated with polyethylene was used as the web material for a coating as described in Example 6. The casting rate was $\nu=400$ m/min. No tendency for the coating to tear was observed. The casting quality was good.

EXAMPLE 8

A coating apparatus according to FIG. 1 was used as the caster for the bead application process for a four layered casting. The casting data for the individual layers are as follows:

| | Accelerating layer | Photographic layer | Photographic layer | Spreading layer |
|---|---|---|---|---|
| $\eta$ | 2 | 50 | 50 | 5 |
| $\delta$ | 2.5 | 40 | 60 | 20 |
| $\partial$ | 31.5 | 29.7 | 24.7 | 28 |

A casting rate of $\nu=400$ m/min could be achieved. The reduced pressure which was applied was 1 mbar with a caster/web spacing of 175 μm. Cellulose triacetate was used as the substrate. The casting quality was very good.

EXAMPLE 9

A caster according to FIG. 1 was used as the caster for the bead application process for a three layered casting. The casting data of the individual layers are as follows:

| | Accelerating layer | Photographic layer | Spreading layer |
|---|---|---|---|
| $\eta$ | 1 | 61 | 2 |
| $\delta$ | 5 | 40 | 10 |
| $\partial$ | 30 | 27.6 | 25.7 |

A casting rate of 250 m/min could be achieved. The reduced pressure which was applied was 4.5 mbar with a caster/web spacing of 175 μm. PE paper was used as the substrate. The casting quality was good.

The Examples which have been provided only illustrate part of the range of use. Other web supports, greater and smaller numbers of layers and other coating materials are possible with an adaptation of the accelerating layer with respect to viscosity and layer thickness.

The spreading layer allows a further improvement in the casting quality and an increase in the coating rate, and the individual layers do not intermix, neither does the accelerating layer mix with the superimposed layer. The spreading layer does not mix with the underlying photographic layer.

We claim:

1. A process for the multiple coating of webs by bead coating wherein the web is continuously moving past a coating point and the layers forming the multiple coating are flowing down a sliding surface of a coating head, characterized in that any number of comparatively high viscosity layers having a viscosity of 50 mPas or more is arranged above an accelerating layer which lies below the layers and has a viscosity range of from 1 to 20 mPas and a layer thickness of from 2 to 30 μm, said process avoiding layer intermixing between the accelerating layer and the comparatively high viscosity layers by carrying out a bead formation over a gap width between the sliding surface coating head and the web to be coated of from 100 to 400 μm, preferably from 100 to 200 μm and a pressure is applied under the coating bead which pressure being reduced from the ambient atmosphere pressure in the range of from 0 to 8 mbar, preferably 0 to 3 mbar.

2. A process according to claim 1, characterised in that an accelerating layer is selected which has a viscosity of from 2 to 10 mPas, in particular from 2 to 3 mPas and a layer thickness of from 2.5 to 10 μm, in particular, from 2.5 to 5 μm.

3. A process for the production of a multilayer photographic material having layers comprised of photographically active coating material comprising the steps of arranging in a multilayer supported on and flowing down a sliding surface of a coating head a plurality of layers free of surface active agents and containing two or more comparatively high viscosity layers having a viscosity of 50 mPas or more arranged above at least one layer of photographically active material, superimposed on a bottom layer slidably supported on the sliding surface and made up of a material selected from the group consisting of polymer solutions, cellulose derivatives, and polysaccharides and having a viscosity of from 2 to 20 mPas and a layer thickness of from 2.5 to 10 μm, said process avoiding layer intermixing between the bottom layer and the comparatively high viscosity layers by transferring the multilayer from the head to a web moving past the sliding surface at a rate of above 100 to 400 m/min, forming a small bead of the multilayer in a gap between the moving web and the sliding surface of a width of from 100 to 200 μm, and maintaining a pressure under the coating bead reduced from the ambient atmosphere pressure in the range of from 0–8 mbar and stretching a high viscosity layer without tearing.

4. A process for the multiple coating of webs by bead coating wherein the web is continuously moving past a coating point and the layers forming the multiple coating are flowing down a sliding surface of a coating head, characterized in that any number of comparatively high viscosity layers having a viscosity of 50 mPas or more is arranged above an accelerating layer which lies below the layers and has a viscosity range from 1 to 20 mPas and a layer thickness of from 2 to 30 μm, said process avoiding layer intermixing between the accelerating layer and the comparatively high viscosity layers, by carrying out a bead formation over a gap width between the sliding surface coating head and the web to be coated of from 100 to 400 μm, preferably from 100 to 200 μm and a pressure is applied under the coating bead which pressure being reduced from the ambient atmosphere pressure in the range of from 0 to 8 mbar, preferably 0 to 3 mbar and characterized in that another low viscosity layer having a viscosity range of from 1 to 10 mPas and a layer thickness of from 5 to 20 μm is arranged, as a spreading layer, above the low viscosity accelerating layer and any number of comparatively high viscosity layers.

5. A process for the production of a multilayer photographic material having layers comprised of photographically active coating material comprising the steps of arranging in a multilayer supported on and flowing down a sliding surface of a coating head a plurality of layers and containing at least one layer of photographically active material having a viscosity of at least 50 mPas, superimposed on a bottom layer, said bottom layer being slidably supported on the sliding surface and made up of a material selected from the group consisting of polymer solutions, cellulose derivatives, and polysaccharides and having a viscosity of from 2 to 20 mPas and a layer thickness of from 2.5 to 10 μm, transferring the multilayer from the head to a web moving past the sliding surface at a rate of above 100 to 400 m/min, forming a small bead of the multilayer in a gap between the moving web and the sliding surface of a width of from 100 to 200 μm, and maintaining a pressure under the coating bead reduced from the ambient atmosphere pressure in the range of from 0–8 mbar.

* * * * *

UNITED STATES PATENT AND TRADEMARK OFFICE

CERTIFICATE OF CORRECTION

PATENT NO. : 4,572,849

DATED : February 25, 1986

INVENTOR(S) : Gunther Keopke et al

It is certified that error appears in the above-identified patent and that said Letters Patent is hereby corrected as shown below:

Cover page, column 2, in the Abstract, third line from bottom, change "coating head" to -- coating bead --.

Signed and Sealed this

*Twelfth* Day of *August 1986*

[SEAL]

*Attest:*

DONALD J. QUIGG

*Attesting Officer*

*Commissioner of Patents and Trademarks*